US006989790B1

(12) United States Patent
Rees

(10) Patent No.: US 6,989,790 B1
(45) Date of Patent: Jan. 24, 2006

(54) INTEGRATED ANTENNA DEVICE WITH RESISTIVE CONNECTION

(75) Inventor: Huw David Rees, Worcestershire (GB)

(73) Assignee: QinetiQ Limited, London (GB)

( * ) Notice: Subject to any disclaimer, the term of this patent is extended or adjusted under 35 U.S.C. 154(b) by 1826 days.

(21) Appl. No.: 06/492,051

(22) Filed: May 5, 1983

(30) Foreign Application Priority Data

May 11, 1982 (GB) ..... 8213349

(51) Int. Cl.
*H01Q 1/00* (2006.01)
*H01Q 9/16* (2006.01)
*H01P 1/00* (2006.01)

(52) U.S. Cl. ..... 343/700 MS; 343/720; 343/722; 343/802; 333/247; 333/250

(58) Field of Classification Search ..... 343/700 MS, 343/720, 722, 802, 374, 754; 333/247, 250; 455/327; 342/374
See application file for complete search history.

(56) References Cited

U.S. PATENT DOCUMENTS 4,146,896 A * 3/1979 Baril et al. ..... 343/374
4,251,817 A * 2/1981 Kimura et al. ..... 343/700 MS
4,301,429 A * 11/1981 Goldman et al. ..... 333/247
4,430,758 A * 2/1984 Snyder ..... 333/247

* cited by examiner

*Primary Examiner*—Gregory C. Issing
(74) *Attorney, Agent, or Firm*—Nixon & Vanderhye P.C.

(57) ABSTRACT

A planar metal antenna mounted on a semiconductor body and incorporating an active circuit element, for example a diode, integrated in the path of the antenna. Connection between the antenna metal and a peripheral contact is provided by a connecting link of resistive sheet material sub-divided, by voids or by inclusions of high resistive material, into a number of conductive tracks each of width and spacing of dimension small compared with the width of the antenna. The link thus exhibits an effectively high sheet resistivity at high frequency—i.e. at a frequency at or near to the frequency of antenna resonance and thus affords effective hf isolation between the antenna and the contact. At the same time, at dc and at intermediate frequency, a relatively low resistance path is afforded for bias and for extraction of IF signal. The number, width and spacing of the tracks may be varied with distance from the antenna metal to minimize the dc resistivity. Thus the track density may be graded; the link may be comprised of several sections each of different track density. Alternatively, the track density may be made a tapered function of distance from the antenna metal by variation of the size and density of voids or high resistivity inclusions. The connection may be formed of material overlying the semiconductor body. Alternatively, it may be defined in the semiconductor body by dopant implant.

6 Claims, 3 Drawing Sheets

INTEGRATED ANTENNA DEVICE WITH RESISTIVE CONNECTION

TECHNICAL FIELD

Figure 1:
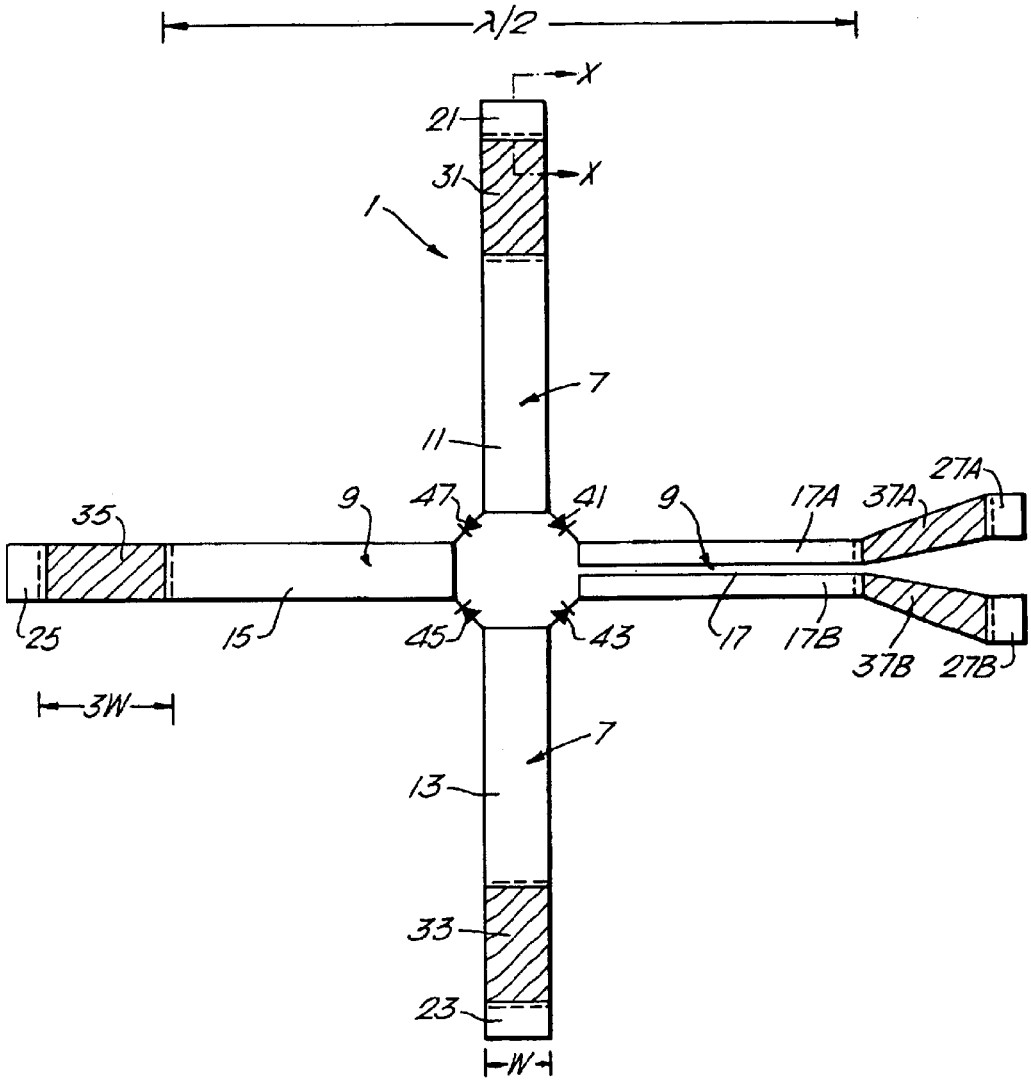

The present invention concerns an integrated antenna device—for example an integrated antenna-receiver—a device having a body of semiconductor material, a planar metal antenna supported on the body, and one or more circuit elements incorporated in the semiconductor body, elements integrated with the metal antenna. Resistive connection is provided between the antenna device and corresponding contacts located remote from the antenna metal, to facilitate the coupling of the device to operative components—for example to power source or bias supply components, components external to the device, or to input control circuitry or output processing circuitry—components external to the device or incorporated in the semiconductor body at locations remote from the antenna metal.

BACKGROUND

Integrated antenna-receivers, and antenna-transmitters, for millimetre-band, have been discussed in Electronics Letters Vol. 17 No 20 pages 729–730 (October 1981). This article refers to receivers and transmitters which include a planar metal dipole antenna on a body of high dielectric constant material—eg semiconductor silicon, and include an active circuit element—eg a field-effect transistor or a Schottky-barrier mixer diode—incorporated between the dipole limbs, and connected across these limbs.

In order to avoid disturbance of antenna resonance and impedance, resistive loading should be minimal. It is a requirement that the resistive connections provided should exhibit high sheet resistivity at high frequency—ie at frequencies at or near dipole resonance. Eg for a half wavelength resonant dipole on a silicon body, a sheet resistivity in excess of 500 Ω/□ (ohms per square) is desirable. It is a problem producing resistive connections of high sheet resistivity, reproduceably. It is thus a problem producing devices with good yield.

In order to avoid reactive coupling between the antenna and the operative components, it is a further requirement that the contacts should be located at some distance from the antenna metal, ie at locations where the amplitude of the electromagnetic fringe field is minimal—eg at a distance a factor of three or more times antenna dipole width from the antenna.

On the other hand, operative components are in general of low impedance, and if operation is to be optimum this requires that the resistance of each connection, at least at low frequency—eg frequencies from d.c. up to say 100 MHz, according to application—should be as low as is possible. But, for example, a sheet connection, of 500 Ω/□ resistivity, to a contact distant three antenna limb—widths from the antenna, would have a minimum resistance of about 1 KΩ. A lower resistance would be desirable.

DISCLOSURE OF THE INVENTION

According to the invention there is provided an integrated antenna device comprising:

- a planar metal antenna on a semiconductor body, with at least one active circuit element incorporated in the semiconductor body, integrated with the antenna;
- a contact located on the semiconductor body, at a point remote from the antenna; and,

- a connection of resistive sheet material, extending between the antenna device and the contact;
- wherein the sheet material connection is subdivided into resistive tracks, each of a width and a lateral spacing small compared with antenna width.

The sheet material may be subdivided thus by voids, or pits, or by regions of very high resistivity, such as produced by ion bombardment or radiation damage of the sheet material.

Since the connection structure is small scale—the tracks are of small width and lateral spacing—at high frequency, the subdivided connection is the equivalent of a uniform resistive sheet. The connection may thus be provided from resistive sheet of relatively low resistivity, with the advantage of robustness and reproduceability inherent in the use of such material, whilst the connection at the same time affords significantly higher effective sheet resistivity.

Furthermore, since the fringe field has high amplitude only in a region close to the antenna, the effective sheet resistivity of each connection may be tapered or graded to reduce the overall resistance of the connection at low frequency. This taper or grading may be achieved by variation in the width, lateral spacing and/or number of the resistive tracks between the antenna circuit and the corresponding contact. Eg. by variation of the density and distribution of voids, or by variation of the number and width of tracks in different sections of the connection.

The connection between contact and antenna circuit may be made as a connection from the contact direct to a circuit element. Alternatively connection between the contact and circuit element may be indirect—ie made via antenna metal, the resistive sheet connection to the antenna device being arranged between the contact and the antenna metal itself.

BRIEF INTRODUCTION OF THE DRAWINGS

Figure 2:
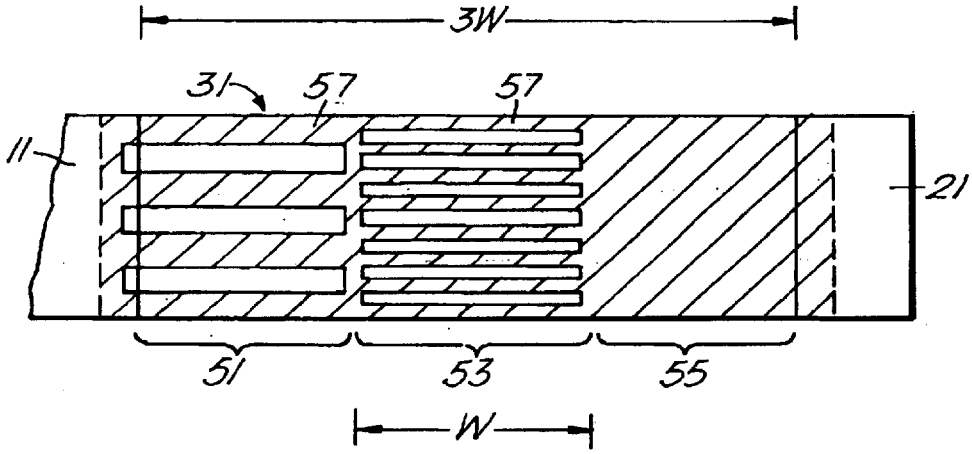
Figure 3:
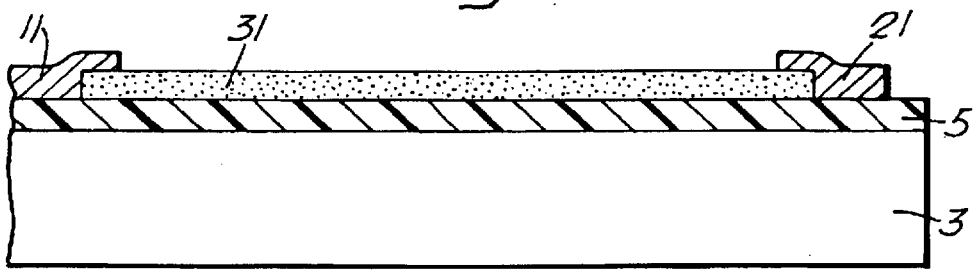
Figure 4:
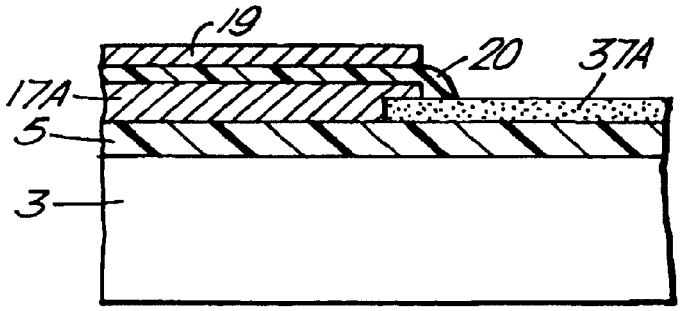

In the drawings accompanying this specification:

FIG. 1: is a plan view of an integrated antenna-receiver with resistive connections between the antenna metal and bias contacts;

FIG. 2: is a detail plan view of one of the resistive connections of the receiver shown in the preceding figure;

FIG. 3: is a cross-section view of part of one of the connections of this receiver, a section taken along the line X-X of FIG. 1 above; and, FIGS. 4 to 7 are cross-section views of alternative connections.

DESCRIPTION OF EMBODIMENTS

Embodiments of the invention will now be described, by way of example only, and with reference to the accompanying drawings.

In FIG. 1, the integrated antenna-receiver shown comprises a planar metal antenna 1 mounted on a supporting body 3, a substrate of semiconductor material, silicon. Insulation between the antenna metal and the semiconductor material is provided by a thin spacing layer 5 of dielectric material—thermally grown silicon dioxide. This prevents the formation of intermetallic compounds between the antenna and the semiconductor.

The planar metal antenna 1 comprises two orthogonal dipoles 7 and 9, each of which is defined by a pair of metal strip limbs—limbs 11, 13 and limbs 15, 17 respectively. One of the four limbs, limb 17, is divided along its length into two portions 17A and 17B. These portions 17A and 17B are isolated at low frequency, but at high frequency they are strongly coupled and behave together as a single limb. Corresponding to each limb there is a bias contact pad; contacts 21, 23 and 25 corresponding to limbs 11, 13 and 15; contacts 27A and 27B corresponding to the portions 17A and 17B of the divided limb 17. Each contact is spaced a distance three times the antenna width, width W as shown, from the end edge of each limb. Resistive connections 31, 33, 35, 37A and 37B are provided, one between each contact 21, 23, 25, 27A and 27B and the metal antenna 1.

At the centre of the metal antenna 1, four active circuit elements, Schottky-Barrier mixer diodes 41, 43, 45 and 47 are arranged head-to-head and tail-to-tail in a ring configuration. Each diode 41, 43, 45 and 47, is connected across a pair of orthogonal limbs, namely the limb pairs 11 and 17, 17 and 13, 13 and 15, and 15 and 11, respectively. Each is incorporated in the semiconductor material body and the diode in each case is connected to the antenna metal through windows in the insulating layer 5, ie each element is integrated with the antenna. At one particular frequency, one of the dipoles—eg dipole 7—is exactly one half-wavelength $\lambda_{eff}/2$ long, where $\lambda_{eff}$ is the effective interface wavelength. The diode impedance is chosen to match the resonance impedance of the antenna 1.

The receiver serves to mix millimetre band radiation signals of orthogonal polarisation—for example an input radiation signal polarised parallel to one dipole—eg dipole 7, and a local oscillator reference signal polarised parallel to the other dipole—eg dipole 9. The low frequency difference signal of around 100 MHz arising from mixing is developed across the two limb portions 17A and 17B when appropriate bias currents are applied to the diodes. Contacts 27A and 27B serve as output contacts. All contacts 21, 23, 25, 27A and 27B need to be connected to external operative components—bias supply components, to provide the required bias currents.

The structure of one of the connections, connection 31 is shown in detail in FIGS. 2 and 3. This connection 31 which is of resistive material—eg polysilicon—extends between the end edge of one of the antenna limbs 11 and the corresponding bias contact 21. The resistive connection 31 has three sections each of length approximately one antenna width W long, namely sections 51, 53 and 55. The first section section 51 nearest the antenna, is a section of high effective resistivity—eg 500 Ω/□ or more. It comprises a grid of resistive tracks 57. The width and spacing of these tracks is small compared with the overall width of the connection—a width comparable to the antenna width W. In the third section, the resistive sheet material is uniform and undivided. The resistivity over this section is thus the sheet resistivity of the connection material—eg 100 Ω/□ nominal resistivity. Between these two sections, in the middle section 53, the sheet material is also divided, but the number, width and spacing of the resistive tracks 57 are different to those of the first section 51. The effective resistivity is of intermediate value—300 Ω/□. Thus total resistance between the antenna limb 11 and the contact 21 is 900Ω approximately for the 100 Ω/□ sheet resistivity polysilicon material. The effective resistivity is graded, but nearest the antenna where high resistivity is pre-requisite, the effective resistivity is 500 Ω/□.

The resistive connections 31 to 37B may be formed simultaneously during the device fabrication. A layer of polysilicon material is deposited on the silicon oxide surface of the semiconductor body. It may be patterned at this stage of the fabrication, using a preformed mask. Alternatively, the pattern of the connections may be delineated by conventional photolithography and the void material between resistive tracks removed with etching. Following this, the antenna metal and contacts are formed by evaporation of a metal layer, photolithographic definition and final etch.

In the example shown, the antenna is resonant at a frequency of 90 GHz, and the antenna length and width for the silicon:air interface are approximately 600 micron and 50 to 100 micron, respectively. The spacing between tracks is less than 20 micron.

In the general case the sheet resistivity of the resistive material will be usually less than 500 Ω/□, but it should not be so low as to act as a metallic layer at high frequency. A reasonable lower limit for this resistivity is the characteristic impedance of the semi-conductor, ie about 100 Ω/□—the value chosen in the example.

In FIG. 1, the high frequency coupling between the split portions 17A and 17B of limb 17 may be improved using an isolated metal overlay 19. This overlay 19 is isolated from the metal limb portions 17A and 17B and from the corresponding connections 37A and 37B by a layer 20 of insulating material (see FIG. 4).

Figure 5:
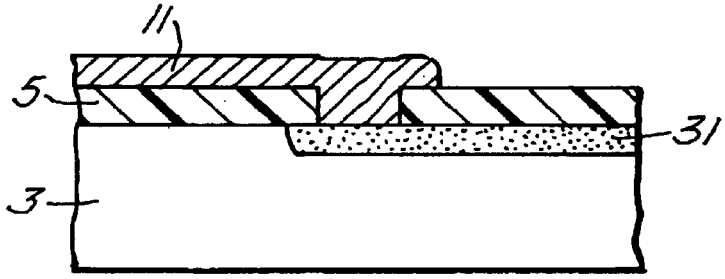

As an alternative to overlay, each resistive connection—eg connection 31—may be incorporated in the body 3 of semiconductor material (see FIG. 5). This can be introduced during device fabrication by implanting and annealing appropriate donor or acceptor species, using a patterned mask to delineate the connection configuration.

Figure 6:
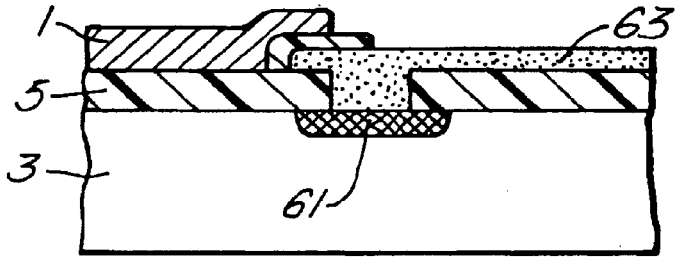
Figure 7:
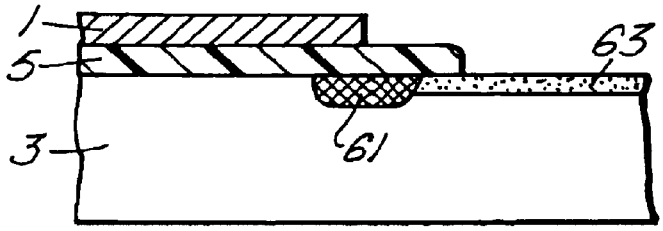

In the variants shown in FIGS. 6 and 7, direct connection is made to an active circuit element 61, an element located beneath the metal of the antenna 1. This element could be, for example, an amplifier transistor beneath the split limb 17 of FIG. 1, used for output signal pre-amplification. The resistive connection, connection 63 can be of overlaid material (cf—FIG. 5) or of incorporated material (cf FIG. 7).

In array structures—devices including many close-spaced antennae, it proves convenient to form connections with the side-edge, rather than the end edge, of each antenna.

I claim:

1. An integrated antenna device comprising:

a planar metal antenna on a semiconductor body, with at least one active circuit element incorporated in the semiconductor body, integrated with the antenna;

a contact located on the semiconductor body, at a point electrically remote from the antenna; and a connection of resistive sheet material, extending between the antenna device and the contact;

wherein the sheet material connection is subdivided into resistive tracks, each of a width and lateral spacing arranged such that the connection is substantially electrically equivalent to a continuous sheet at the antenna resonant frequency.

2. A device as claimed in claim 1 wherein the resistive tracks are spaced by void areas formed in the sheet material.

3. A device as claimed in claim 1 wherein the resistive tracks are spaced by areas of higher resistivity material.

4. A device as claimed in claim 1 wherein the density of the resistive tracks (ie the number, the width and/or the spacing between tracks) is not constant along the connection.

5. A device as claimed in claim 4 wherein the connection is sub-divided in sections each of a different track density.

6. A device as claimed in claim 1 wherein the connection is of heavily doped semiconductor material and is formed in the semiconductor body.

* * * * *